US005356153A

United States Patent [19]

Morse

[11] Patent Number: 5,356,153

[45] Date of Patent: Oct. 18, 1994

[54] BOARD GAME

[76] Inventor: Donald H. Morse, 18659 Palomar Dr., Sun City West, Ariz. 85375-4766

[21] Appl. No.: 170,822

[22] Filed: Dec. 21, 1993

[51] Int. Cl.[5] ..... A63F 3/00

[52] U.S. Cl. ..... 273/248; 273/282.1; 273/283

[58] Field of Search ..... 273/236, 242, 243, 248, 273/249, 280, 283, 282.1

[56] References Cited

U.S. PATENT DOCUMENTS

| | | | |
|---|---|---|---|
| 1,353,728 | 9/1920 | Dence | 273/280 X |
| 3,274,727 | 9/1966 | Zander | 273/283 X |
| 3,847,397 | 11/1974 | Price | 273/282.1 X |
| 4,188,034 | 2/1980 | Dempsey et al. | 273/280 X |
| 4,552,362 | 11/1985 | Oake | 273/280 X |
| 4,811,954 | 3/1989 | Hemmann | 273/283 |

FOREIGN PATENT DOCUMENTS

| | | | |
|---|---|---|---|
| 3305673 | 8/1984 | Fed. Rep. of Germany | 273/283 |

OTHER PUBLICATIONS

"Rocketstar" Board Game, Aug. 1988, 7 pages.

*Primary Examiner*—William E. Stoll
*Attorney, Agent, or Firm*—Hugh E. Smith

[57] ABSTRACT

The game comprises a score sheet having directions printed thereon and a rotatable game board mounted on a base which also serves as a holder for the cards used in the game and as a blind selector for the playing pieces or employees as described below. The playing board is marked off on one side with a plurality of starting points and lines to career positions, each containing a plurality of peg receiving holes, which are reached by following the directions on the cards. The board is segmented into four quadrants and, dependant upon the number of players, one or more of such quadrants is turned over to expose the unmarked side thereof, the upward facing or marked sides always being on contiguous segments. A stack of cards, each carrying one of seven specific directions on its face is provided, with a total of seventeen cards per game piece to be used, such set of seventeen cards being made up of a specific number of each of the direction cards, the combination of cards and upwardly faced game board segments maintaining a viable ratio of job positions available to the number of game pieces being used.

4 Claims, 4 Drawing Sheets

| REVIEW | EMP. NO. | | | | | | | | | | | | | | | | |
|---|---|---|---|---|---|---|---|---|---|---|---|---|---|---|---|---|---|
| | MOVE CARD | POSITION | SALARY PT. | PENSION PT. | | | | | | | | | | | | | |
| 1 | HP | MR | 2 | 2 | | | | | | | | | | | | | |
| 2 | | | | | | | | | | | | | | | | | |
| 3 | | | | | | | | | | | | | | | | | |
| 34 | | | | | | | | | | | | | | | | | |
| 35 | | | | | | | | | | | | | | | | | |
| 36 | | | | | | | | | | | | | | | | | |

16

BOARD GAME

BACKGROUND OF THE INVENTION

1. Field of the Invention

The present invention relates to board games and more particularly pertains to a board game which simulates progression through a period of years in a corporate environment. The game is based on annual reviews of employees (play pieces) and utilizes a board, special cards, player pegs and a score card.

2. Description of the Prior Art

The use of board games is known in the prior art. More specifically, board games heretofore devised and utilized for the purpose of bringing corporate life into a game setting are known to consist basically of familiar, expected and obvious structural configurations, notwithstanding the myriad of designs encompassed by the crowded prior art which have been developed for the fulfillment of countless objectives and requirements. The present game is based on annual reviews of employees and employs a variety of moves and directions specific thereto. Prior art games directed to a corporate setting are shown in U.S. Pat. Nos. 4,354,684; 5,056,792; 4,501,425; 4,062,544; and 4,955,616. All of these differ in concept and play from the game of the present invention wherein annual reviews form the basis of determining the winner.

In this respect, the board game according to the present invention substantially departs from the conventional concepts and designs of the prior art, and in so doing provides an apparatus primarily developed for the purpose of following employees through their corporate life.

SUMMARY OF THE INVENTION

The present invention provides an improved board game construction wherein the same can be utilized to illustrate the part luck plays in corporate life as well as permitting players to exercise strategy to advance, to block rivals and to take advantage of breaks. As such, the general purpose of the present invention, which will be described subsequently in greater detail, is to provide a new and improved corporate board game which has all the advantages of the prior art games and utilizes a different approach.

To attain this, the present invention essentially comprises a corporate life experience game which utilizes a series of "annual" or "performance" reviews to determine ultimate winner. The game utilizes a board marked with a plurality of career paths for advancement and with all participants starting at a common entry level. Direction containing cards are drawn from a "draw pack" (one to a participant in any given annual review period). These may result in promotion to a higher level, demotion, lateral assignment, etc. depending on the luck of the draw. In following the direction indicated on a specific card, the participant utilizes judgement where possible to develop a strategy for improving future opportunities and/or to block a rival's optimum path to promotion. Each move generates "salary points" indicated on the board and "pension points" (a cumulative value of amassed salary points which are scored as discussed herein). The play continues for 18 "annual reviews" and then at the "mid-life" point of play, the used cards are collected, shuffled and restacked as the "draw pack", and the game continues for a total of 35 "annual reviews" or to such point after completion of any "annual review" that the participants wish to terminate. Player having the maximum number of pension points is the winner.

Physically, the game comprises a score sheet having directions printed thereon and a rotatable game board mounted on a base which also serves as a holder for the cards used in the game and as a blind selector for the playing pieces or "employees" as described below. The playing board is marked off on one side with a plurality of starting points and lines to career positions, each containing a plurality of peg receiving holes, which are reached by following the directions on the cards. The board is segmented into four quadrants and, dependant upon the number of players, one or more of such quadrants is turned over to expose the unmarked side thereof, the upward facing or marked sides always being on contiguous segments. A stack of cards, each carrying one of seven specific directions on its face is provided, with a total of seventeen cards per game piece to be used, such set of seventeen cards being made up of a specific number of each of the direction cards, the combination of cards and upwardly faced game board segments maintaining a viable ratio of job positions available to the number of game pieces being used.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved corporate board game which has all the advantages of the prior art games and none of the disadvantages.

It is another object of the present invention to provide a new and improved corporate board game which may be easily and efficiently manufactured and marketed.

It is a further object of the present invention to provide a new and improved corporate board game which is of a durable and reliable construction.

An even further object of the present invention is to provide a new and improved corporate board game which is susceptible of a low cost of manufacture with regard to both materials and labor, and which accordingly is then susceptible of low prices of sale to the consuming public, thereby making such games economically available to the buying public.

Still another object of the present invention is to provide a new and improved corporate board game for up to twelve players.

Yet another object of the present invention is to provide a new and improved corporate board game utilizing the concept of annual or performance reviews to determine the game winner.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

With reference now to the drawings, a new and improved corporate board game embodying the principles and concepts of the present invention will be described.

FIGS. 1 through 7 illustrate the physical elements used in the present invention and their functions will be more clearly understood when read in conjunction with the description of game play below.

Figure 1:
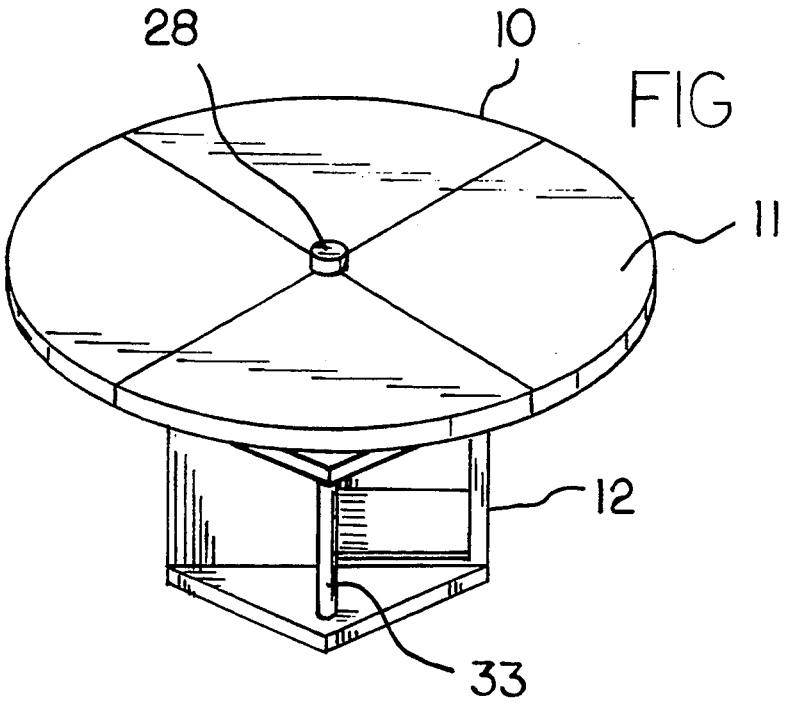
FIG. 1 is a perspective view of the board and support used in the present invention.
Figure 2:
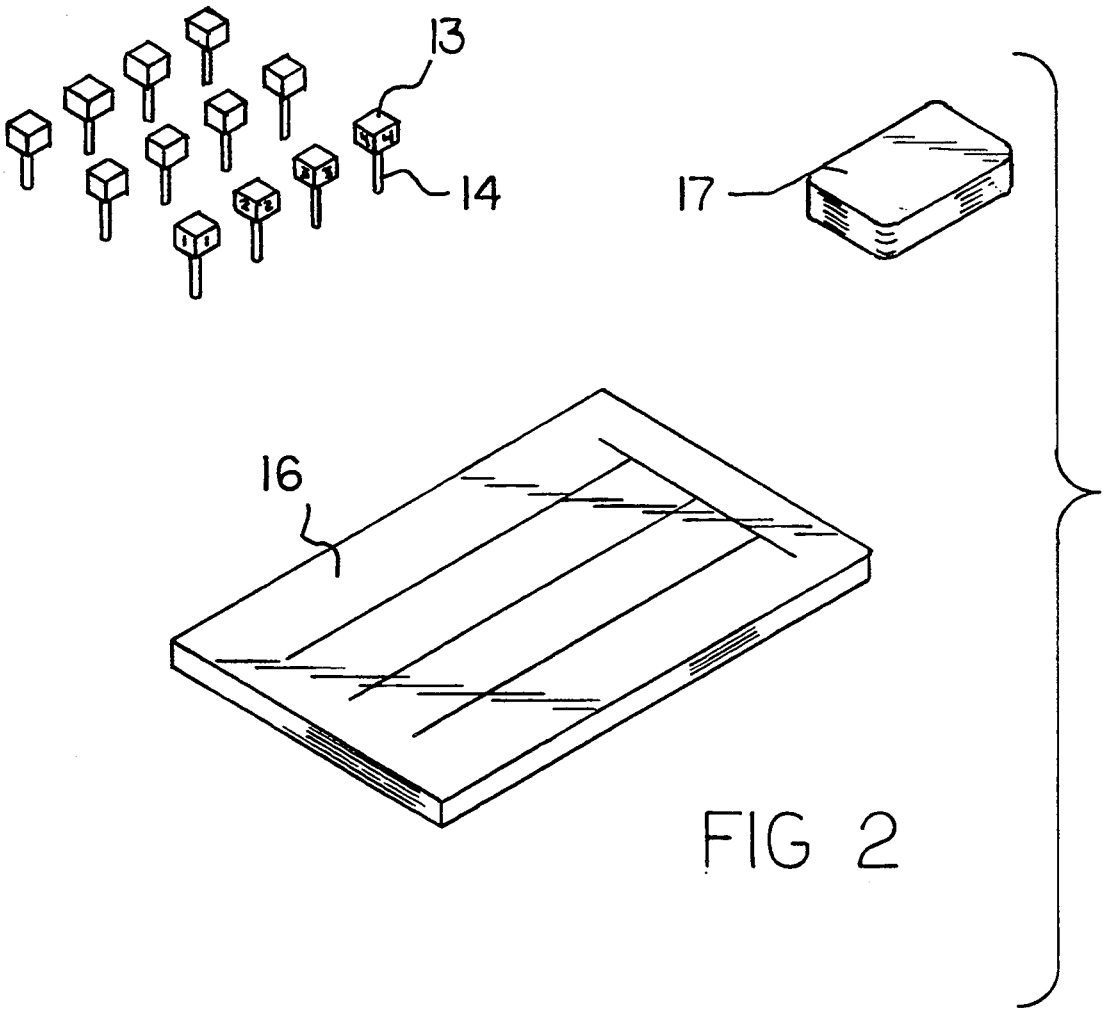
FIG. 2 is an exploded perspective view of the other major components of the game of the present invention.
Figure 3:
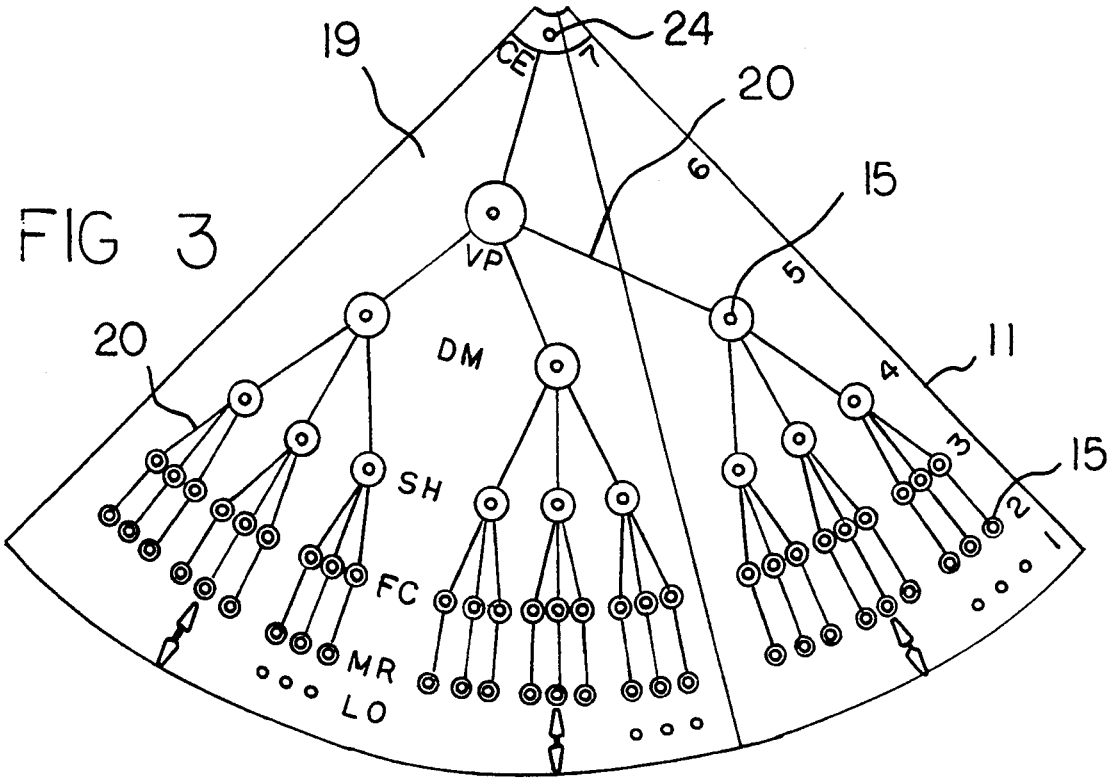
FIG. 3 is top plan view of one quadrant of the playing board of the present invention.

FIG. 1 shows the game board 10 divided into quadrants 11 and rotatably mounted on a pivot pin 28 extending from a compartmented member base 12. A front handle rod 33 permits holding the base 12 while rotating board. FIG. 2 illustrates the remaining elements used with board 10. Along with the game board 10 as described below, are player pieces 13 designating "employees", such player pieces being cubes each carrying an identifying number on its surfaces and having a depending peg 14 adapted to fit into holes 15 (as shown in FIG. 3). A score sheet 16, shown in more detail in FIG. 7 and a draw pack 17 of cards 18 shown in detail in FIG. 6 complete the elements required.

The game board 10 as aforesaid is divided into separable quadrants 11. The upper surface 19 of each quadrant is marked with career path lines 20 as shown in FIG. 3. The bottom surfaces (not shown) of quadrants 11 are free of the marking 20 used on the top surface 19 although they may carry decorative or other markings not forming a part of the invention thereon or may be left blank as desired. Each career path has seven levels designated by numerals 1 through 7 on the board surface 19. These designations also constitute "salary" designations for each level. The levels also carry letter designations as follows: entry level, i.e. 2, carries the designation "MR" standing for "Mail Room"; the next, "FC", stands for" File Clerk"; then "SH" standing for "Section Head"; "DM" standing for "District Manager"; "VP" standing for "Vice President"; and finally "CE" standing for "Chief Executive". The first level "1" has holes for player pegs which have "unemployed" or "laid off" status as explained below.

Figure 4:
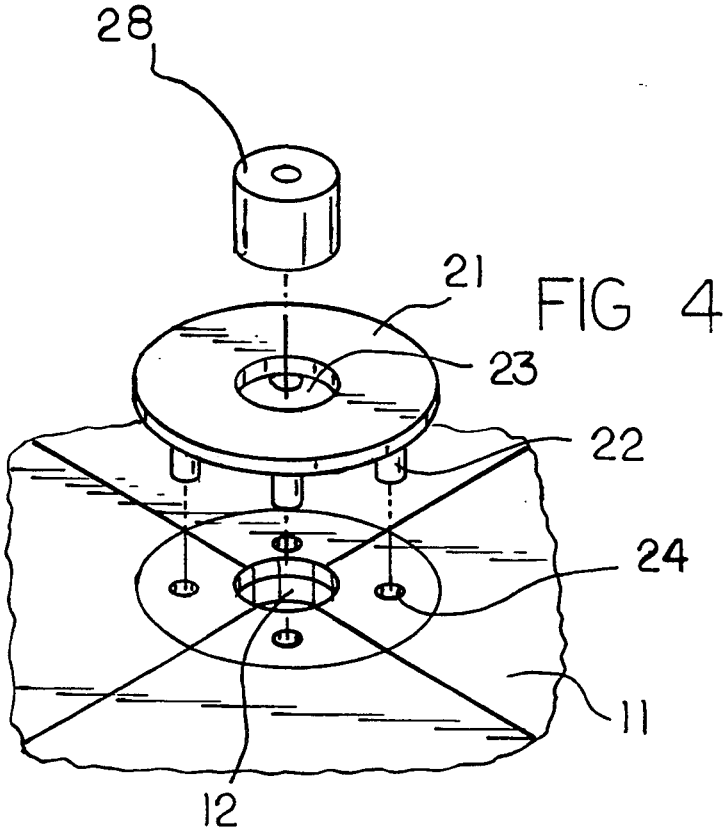
FIG. 4 is an exploded perspective view of the turntable arrangement used to mount the board of the present invention.

FIG. 4 shows the pivot arrangement for game board 10 and comprises a central board or pin ring mounts 21 having a pivot pin 28 adapted to fit through hole 23 extending through ring mounts 21. Pin ring mounts 21 is positioned on board quadrants 11 by pins 22 engaging in holes 24 in said quadrants 11, permitting rotating such quadrants 11 around pivot pin 28 relative to base member 12. Said pin 28 extends freely through the hole 23 in pin rin 21 mounted to the top of board 11 by pins 22. Pins 22 engage in holds 24 to permit rotating board 11 around pivot pin 28 relative to base member 12.

Figure 5:
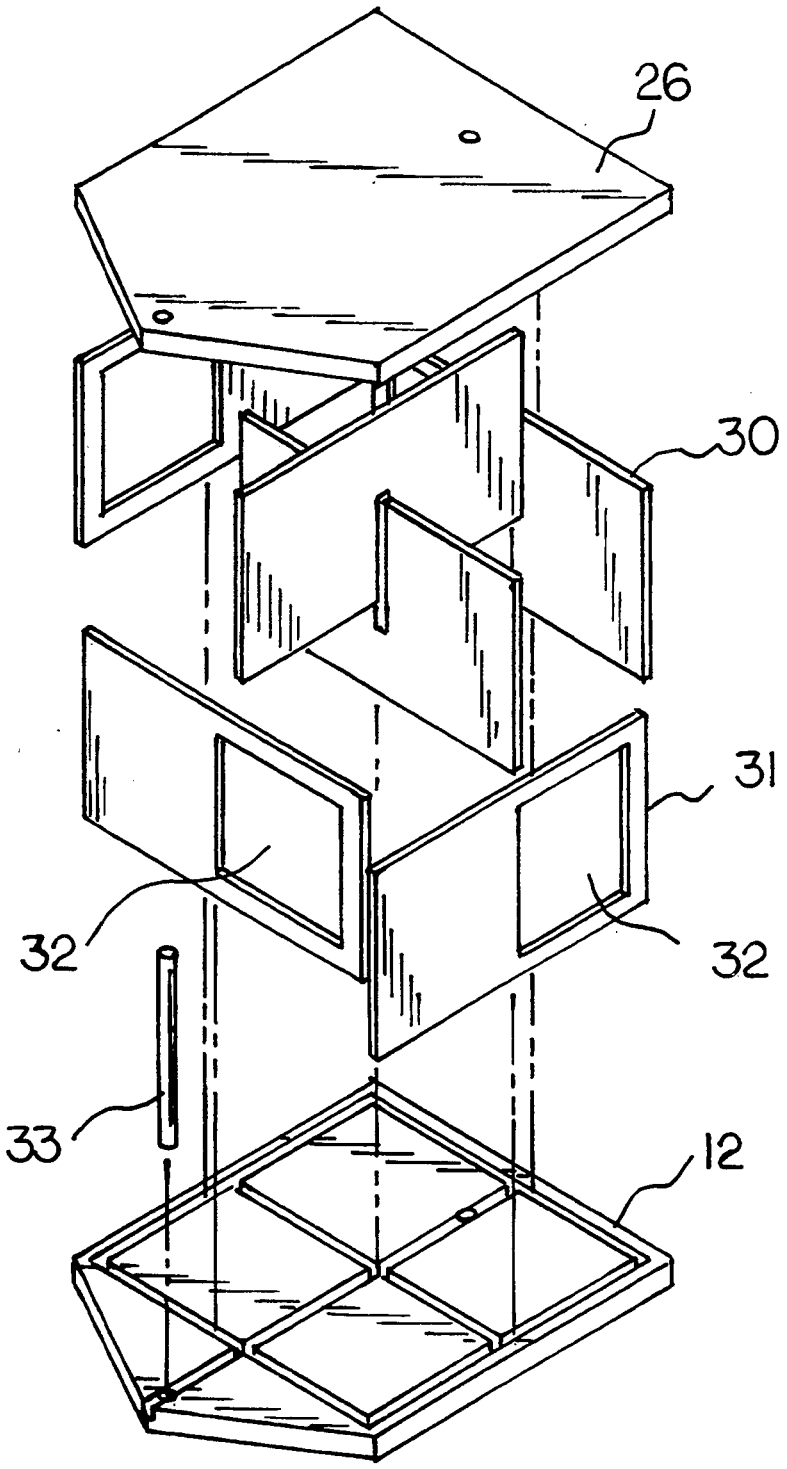
FIG. 5 is an exploded perspective view of the game box and support for the arrangement of FIG. 4.

FIG. 5 shows the base member 12 and illustrates that it is formed by the use of removably interlocked press-fit panels 10. The construction permits disassembly and storage of the components in a small space when the game is not in use. It will be noted that the side panels 31 each have an opening or window 32 therein to permit access to the interior compartments of the assembled base unit 12. One window 32 provides access to the "draw" pack of cards, one to provide a discard compartment for cards and one to serve as a "blind" selector access for drawing the numbered player pieces 13 at the start of each game.

Mounted at the front of base member 12 is a front handle rod 33. When board 10 is rotated by a player to line up OEP arrow with rod 33 (see below), the player gains an optimum line of sight to show openings and/or blocks for determining entry points and/or lateral moves.

Figures 6, 7:
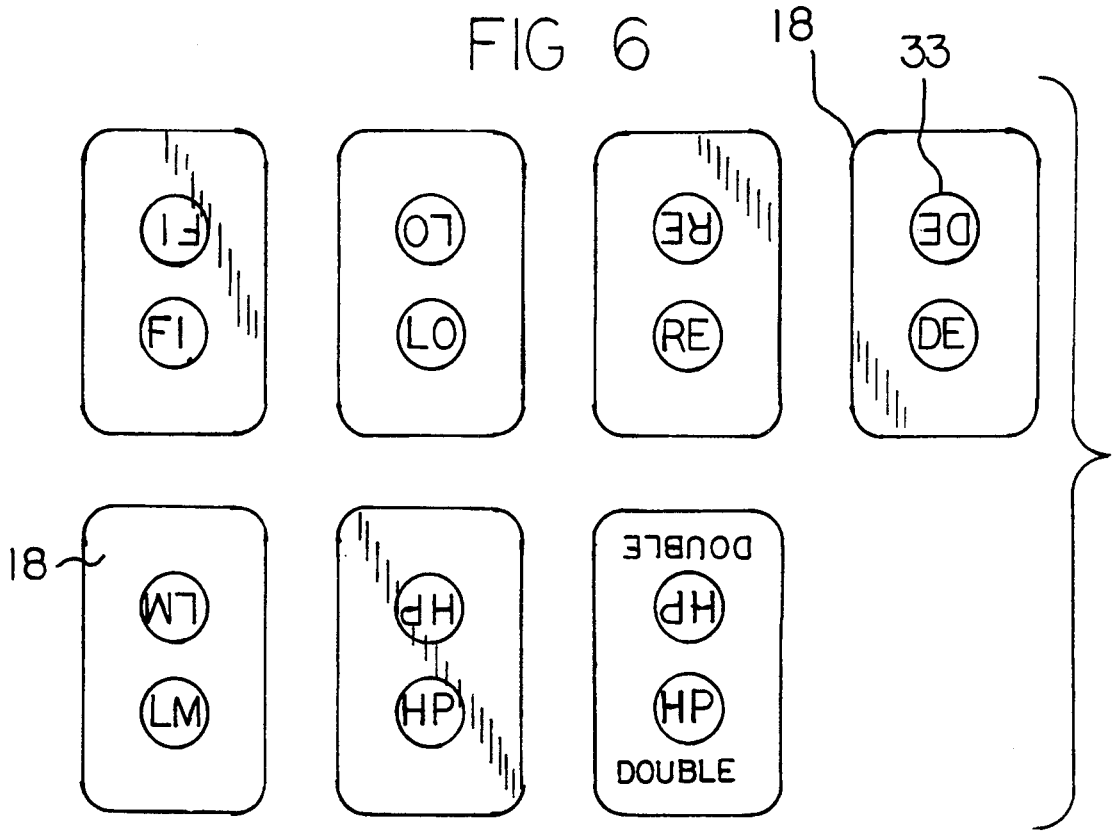
FIG. 6 is a plan view of the special cards used in the game of the present invention.
FIG. 7 is a plan view of a portion of the score sheet of the present invention.

FIG. 6 illustrates that special cards 18 are used for this game, card carrying special indicia 33. There are seven differently marked cards and a specific number of each is utilized in the game dependent upon the number of playing pieces being used (see description of "Play" below).

A score sheet 16 is partially shown in FIG. 7. In addition to the necessary designations and columns shown herein, the score sheet will contain play "Company Policies", i.e. directions (not shown). The score sheet has thirty-six horizontally disposed lines numbered consecutively from 1 to 36. These represent annual reviews, the first of which is fixed and preprinted as shown. A plurality of boxes marked "Employee No._" is disposed above the annual review lines, each such box having vertical lines defining boxes with each annual review line to receive information recorded as the game progresses. Each employee box has thereunder spaces for the move card drawn, the position resulting from the move, salary points and pension points (as explained below).

Play of Game

Once the physical assembly of the game is completed using the elements shown in the drawings, play commences.

Step I: Determine number of playing pieces to be used.

A. Game may be played with from two to twelve participants designated as "sponsors".

B. Normally each sponsor will operate with one "employee" or playing piece; however since at least six playing pieces should be in use for any one game, in case of fewer than six sponsors, some or each sponsor may handle more than one employee to bring total up to six or more.

Step II: Arrangement of board quadrants.

A. All board quadrants face-up is the optimum and is used where twelve employees (playing pieces) are to be employed.

B. As number of employees decrease to start a game, one or more quadrants is inverted to take the area thereof out of play.

C. Each quadrant has three block arrows designating an "OEM" or optimum entering point.

D. Sufficient quadrants should be left face-up to give each player an available OEM, e.g. with six players, two quadrants should be face-up.

Step III: Select employees.

A. Each sponsor reaches into the "blind" hole in the base support member box and takes a playing piece for each employee to be used or sponsored.

Step IV: Prepare "draw pack" of cards.

A. An "employee pack" of cards comes pre-assembled (and should be made up again at end of game).

B. Each employee pack contains a pre-determined set of cards assembled from seven different indicia-carrying cards:

HP—hired-promoted card
LM—lateral move card
RE—remain card
DE—demoted card
FI—fired card
LO—lay-off card
HP(Double)—allows for double up-grade if not blocked C. Each "employee pack" contains the following:

7—HP cards
3—LM cards
3—RE cards
1—FI card
1—LO card
1—DE card
1—HP(Double) card Note: Since game provides for up to 12 employees, total number of cards equals 12 times above, or 204.

D. One employee pack is selected for each employee (playing piece) to be used in the game.

E. Cards are then shuffled together and stacked face down in the base member box compartment.

Step V: Initial placement of employees.

A. All employees start at the same level in the MR or mailroom spots.

B. Each sponsor (player) puts his employees into a slot with those designated by a black arrow as an OEM (See II C above), proceeding in sequence by employee number.

C. Each sponsor scores his employee(s) in the first box on the score sheet with each getting 2 salary points and 2 pension points as indicated on face of game board.

Step VI: Initiation of first annual review.

A. Starting with the sponsor of the lowest number employee, a card is drawn from the draw stack in the base support member. The employee peg is moved as per direction on the drawn card subject to restrictions in "Company Policy" printed on score sheet (see item IX below).

B. Board is then passed to sponsor of next numbered employee and procedure is repeated.

C. Upon completion by all sponsors, the first annual review is completed, each sponsor filling in the boxes on the score sheet for his employee(s). Pension points are a cumulative total of the salary points for each employee.

Step VII: Mid-life crisis.

A. This occurs when the first seventeen annual reviews have been completed.

B. At this point, all cards have been drawn, followed and placed in discard compartment of the base member.

C. Cards are reshuffled, restacked in a draw pack and play continues.

Step VIII: Determination of winner.

A. After completion of final review (35th if game goes to termination); or

B. At any point after completion of an annual review if the sponsors agree.

C. Pension points for each employee are compared and highest value is the winner.

Item IX: Company Policies

A. These provide some limitations on moves with the limitations becoming stricter as level of the employee's position goes up.

B. They also give more detailed instruction on how moves may be made.

C. Policies listed on score card are:

I. Move cards

A. Hired/Promoted "HP"

1. Employee moves along job lines to next higher spot, unless blocked (i.e. spot occupied)
2. Double hired/promoted "HP Double" employee moves along job lines to second higher spot, unless blocked, in which case is treated as a regular "HP".
3. If unemployed, U, or on layoff, LO, employee moves to mailroom, MR.
   a. Employee must reenter same department from layoff, LO, but may reenter any department from unemployed, U.
4. Employee in CE spot does not move.

B. Lateral Move "LM"

1. Employee moves sideways in either direction to same kind of job spots, unless blocked.
   a. Laid-off LO does not move
   b. Mailroom MR and File Clerk FC must move at least 3 spots in either direction, but can move to any spot in same department.

c. Section head SH moves exactly 3 spots. If one direction is blocked must move to other. If both blocked does not move.

d. Department manager DM moves exactly 2 spots under same conditions.

e. Vice president VP moves exactly 1 spot under same conditions.

f. CE moves to unemployed status U.

C. Remain "RE"

1. Employee does not move, but scores points for current spot.

D. Demoted "DE"

1. Employee moves to next lower spot along job lines, unless all 3 spots are blocked, in which case moves to second lower spot along job lines.

2. Employee cannot be demoted from mailroom MR, layoff, LO or unemployed U positions.

E. Laid-Off "LO"

1. Employee moves to lay-off spot in same department. Must get HP or Double HP to reenter, in same department.

2. Lateral move "LM" and demoted "DE" do not apply to lay-off.

F. Fired "F"

1. Employee is removed from board and considered unemployed U.

Note: All moves that cannot be made for whatever reason should be circled on score sheet, to provide an excuse for an unsuccessful career.

II. Strategy

A. Initial entry or reentry to MR

1. Sight line from optimum entry point indicates potential or actual blocks.

B. Lateral Move "LM"

1. Sight line from current employee spot to CE spot will indicate opportunities to create or to avoid blocks.

2. It is sponsor's advantage to block whenever possible. With 8 HPs and Double HPs to 9 all others, it is possible for any employee to draw a series of advancement cards and block another from its aimed-for spot, since the number of available job spots diminishes in a 3 to 1 ratio as each step is reached.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

For example, in order to decrease time of play, the number of reviews may be reduced to 25 with the break (Mid-life Crisis) coming after the 13th review. In this variation, the number of cards in each "Player Pack" would be reduced to twelve:

5—HP cards

2—LM cards 1 each of balance of card types

Other changes or modifications in play can be made at the discretion of players to fit any specific needs which may arise.

What is claimed as being new and desired to be protected by Letters Patent of the United States is as follows:

1. A new and improved corporate board game which comprises: a game board divided into four removable and reversible quadrants, one side of each of said quadrants being a playing surface carrying indicia and having perforated career paths for advancement thereon, the other side of said quadrants indicating a non-playing surface; a plurality of numbered game pieces each representing an employee said pieces being adapted to be engaged in perforations of said career paths; a base support member for said game board subdivided into internal compartments accessible from the exterior thereof to hold respectively said game pieces prior to selection by a player; a stack of marked cards for play; and a discard stack of cards played, rotatable means atop said base support member to rotatably mount said game board thereon; said marked cards consisting of a specific number of each of a set of seven different direction bearing cards per game piece, said sets for the total number of game pieces in use being shuffled together, assembled into a draw stack and inserted in a compartment of said base member; and a score card providing lines for recording 36 annual reviews of each employee, said reviews including salary points, specified on the game board, and pension points which are the accumulated total of said salary points, and a tabulation of company policy rules which cooperate with the direction on said cards to determine the employee's progress along said career path.

2. A game as in claim 1 wherein said career paths provide six levels for advancement by following directions on said cards as modified by said company policy rules, each position on each of said career paths having at least one perforation adapted to receive a game piece therein if said perforation is open at the time of a given move.

3. A game as in claim 1 wherein said marked cards identify the move for a player drawing a specific card to be:

a. Hired-promoted (HP)

b. Laterally moved (LM)

c. Remain in place (RE)

d. Demoted (DE)

e. Fired (FI)

f. Laid-off (LO)

g. Doubly up-graded (HP Double).

4. A game as in claim 1 wherein each set of said marked cards for each employee consists of a total of seventeen such cards divided to provide a specific number of each card with 7—HP cards; 3—LM cards; 3—RE cards; 1 each of the FI, LO, DE and HP Double cards.

* * * * *